United States Patent [19]

Sommer

[11] Patent Number: 4,465,445

[45] Date of Patent: Aug. 14, 1984

[54] ROTARY PIVOTED VANE PUMP

[75] Inventor: Manfred Sommer, Untergruppenbach-Vorhof, Fed. Rep. of Germany

[73] Assignee: Ursula Sommer geb. Heyd, Baden-Wurttemberg, Fed. Rep. of Germany

[21] Appl. No.: 327,057

[22] Filed: Dec. 3, 1981

[30] Foreign Application Priority Data

Dec. 6, 1980 [DE] Fed. Rep. of Germany ..... 3046155

[51] Int. Cl.[3] ..... F04C 2/00; F04C 15/00

[52] U.S. Cl. ..... 418/152; 418/178; 418/226; 418/255; 418/261

[58] Field of Search ..... 418/152, 178, 226, 227, 418/233, 255, 261, 265; 285/157, 137 R; 17/36, 37

[56] References Cited

U.S. PATENT DOCUMENTS

| | | | |
|---|---|---|---|
| 249,345 | 11/1881 | Halstead et al. | 418/226 |
| 601,158 | 3/1898 | Murphy | 418/255 |
| 1,263,639 | 4/1918 | Bertsch | 418/226 |
| 2,776,086 | 1/1957 | Selden | 418/152 |
| 2,966,860 | 1/1961 | Maynard | 418/178 |
| 3,310,322 | 3/1967 | Carroll | 285/157 |
| 3,895,893 | 7/1975 | Sommer | 418/226 |

*Primary Examiner*—John J. Vrablik

*Attorney, Agent, or Firm*—Robert E. Burns; Emmanuel J. Lobato; Bruce L. Adams

[57] ABSTRACT

A pivoted vane rotary pump especially for pumping food-stuff and abrasive material comprises a split housing in which a hub is rotatable, with an annular channel formed between the outer periphery of the hub and the inner periphery of the housing. Pivoted vanes on the hub are rotatable about radial axes between a position in which they are crosswise of a transport portion of the channel between an intake and a discharge and a position in which they move edgewise in a restricted sealing portion of the channel between the discharge and the intake. The housing is lined with elastomeric plastic material which is vulcanized to metal housing parts of pumps for handling foodstuff or corrosive media, or is vulcanized to metal carrier plates removably secured to housing parts of pumps for handling abrasive media. The pump can be easily disassembled for cleaning and for servicing, including replacement of the plastic lining of pumps for abrasive media. In one embodiment, a plastic axial guide member secured to the hub engages annular shoulders on pivot shafts of the vanes to prevent axial movement while permitting pivoting of the vanes.

23 Claims, 10 Drawing Figures

ROTARY PIVOTED VANE PUMP

FIELD OF INVENTION

The present invention relates to a rotary pivoted vane pump comprising a split metal housing having circumferentially spaced intake and discharge and an inner space in which is rotatable a rotor comprising a hub having an outer diameter which is smaller than the inner diameter of the housing and a plurality of pivoted vanes extending radially from the hub and moving in an annular channel between the outer periphery of the hub and the inner periphery of the housing. The circumferential distance between the intake and the discharge in the direction of rotation of the rotor is not less than the distance between the discharge and the intake. The annular channel has a sealing portion of restricted cross section between the discharge and the intake in the direction of rotation of the rotor and a transport portion of larger cross section between the intake and the discharge. The vanes are rotatable so as to have a smaller cross section in a plane containing the axis of rotation when passing through the sealing portion and a larger cross section when passing through the transport portion, thus conforming to the cross section of the channel. The number of vanes and the circumferential spacing of the intake and discharge are such that there is always at least one vane in the sealing portion of the annular channel.

BACKGROUND OF THE INVENTION

Of rotary pivoted vane pumps two principal types are known. In one type the vanes are disc-form and are rotatable about pivot axes which are radial to the axis of rotation of the rotor. In the transport channel portion the vanes are perpendicular to their direction of movement while in the sealing portion of the channel they are parallel to the direction of movement. Because of their disc form, the cross sectional area of the blades in a plane containing the axis of rotation of the rotor is greater in the transport portion of the channel than in the sealing portion. The pivoted vanes are frequently formed as flat circular discs. Pumps of this kind are described for example in U.S. Pat. Nos. 3,895,893 and 3,985,479.

In another type of pivoted vane rotary pumps the pivot axes of the vanes are parallel rather than radial to the axis of rotation of the rotor. In many pumps of this kind the vanes are retracted into recesses in the hub so that their cross sectional area in a plane containing the axis of rotation is zero in the sealing portion of the channel. Radial pivoted vane pumps of this kind are described for example in German patent specification No. 28 45 658. In order to cause the vanes to pivot, the transport channel is frequently formed so that it is restricted at one side of the pivot axis so that the vanes are caused to pivot by the restriction. The return movement of the vanes is effected either by springs or by coupling a vane with a vane at the opposite side of the axis of rotation so that pivoting of one vane by the narrowing of the transport channel will cause the opposing vane to pivot to open position.

Pivoted vane rotary pumps have particularly desirable pumping characteristics for certain applications. For example they are superior to other pumps for pumping abrasive materials such as chrom (III) oxide sludge or for pumping delicate food-stuff such for example as whole fruit in a syrup, soup containing solid pieces or salads.

In pumping foodstuffs there is not only the problem that they must be carefully handled but also the further problem that the hygienic condition of the pump must be carefully maintained and also that pump parts must not be attacked through corrosive media such for example as fruit acids or vinegar. In order to avoid such attack of the pump parts, pumps for use in the sanitary field have heretofore been produced of stainless steel.

For pumping highly abrasive material, pivoted vane rotary pumps have heretofore used an expensive pivoted vane construction in which the vanes have a plastic covered metal core with special sealing attachment.

In accordance with the present invention there is provided a pivoted vane rotary pump which is of simple construction and easily produced and with which on the one hand food-stuffs can be gently and hygienically pumped while on the other hand abrasive media can be pumped in an abrasion resistant manner.

SUMMARY OF THE INVENTION

In accordance with the present invention, the entire annular channel of a pivoted vane rotary pump is covered with a one piece plastic layer of which the inner cross section of the transport channel portion conforms to the outer cross section of the pivoted vanes. The use of an elastomeric plastic material is particularly advantageous.

Through the complete covering of the annular channel it is assured that no aggressive material such as fruit acid or vinegar can come into contact with the metal parts of the pump housing. Hence, it is no longer necessary to make the pump housing of stainless steel. The housing can be very easily produced of cast iron or an aluminum casting.

The pivoted vanes can also be made of plastic material. However, for strength and antifriction properties, it is more advantageous to make the vanes of metal, in particular stainless steel. Because of the simple form which the vanes as a rule have, producing the vanes of stainless steel poses no problem.

For pumps to be used in the sanitary field it is advantageous for the plastic covering to be bonded directly to the housing parts. This can be achieved for example by vulcanizing suitable elastomeric material on the housing parts for example at a temperature between 150° and 200° C. It is thereby assured that even low viscosity food parts cannot enter between the plastic covering and the metal housing parts whereby the danger of unsanitary or disease producing conditions is avoided.

Outside the sanitary field the tight bonding between the plastic covering and the metal parts is not required. For pumping highly abrasive media, it is more advantageous for the plastic covering to be easily removable and interchangeable. In order to hold the plastic covering securely, it is first vulcanized onto a metallic carrier which is then secured to the housing parts, for example by screws. A plastic covering of this kind is stable, is highly wear resistant and when it is becomes worn through long use it can easily be replaced by a new plastic covering.

Besides the annular channel, the bearings of the pivot pins for the pivoted vanes of a pivoted vane rotary pump are also subject to attack by corrosive or abrasive material. In order also to protect the pump parts in this area, the pivot pins of the vanes are rotatable in plastic bushings. Such plastic bushings are highly resistant to wear.

By reason of the inclusion of plastic parts, a pivoted vane rotary pump can no longer be used in the wide temperature range which is possible when the pump is made exclusively of metal parts. To overcome this difficulty, the housing is provided with cooling channels which are so formed that the metallic housing wall between the cooling channels and the plastic covering is only as thick as is required for stability. Instead of a cooling medium, a heating medium can be circulated through these channels. Through the limited wall strength between the channels and the plastic covering, there is provided good heat conductivity which assures that the plastic covering is not overheated or overcooled.

Pumps of this kind which are used in the sanitary field must be frequently cleaned. On the other hand, with pumps for highly abrasive media the plastic cladding must be frequently changed. It is therefore a particular advantage that a pump of this kind is made in such manner as to be easily assembled and disassembled. In order to accomplish this, the housing base and housing cover are made with flanges through which screws extend and the hub has a driving coupling which is secured on the driving shaft by an easily removable screw. With this construction the pump can with little manipulation be fully disassembled so that thorough cleaning or quick replacement of worn parts can be carried out.

BRIEF DESCRIPTION OF DRAWINGS

The nature, objects and advantages of the invention will be more fully understood from the following description of preferred embodiments shown by way of example in the accompanying drawings in which.

DESCRIPTION OF PREFERRED EMBODIMENTS

Figure 1:
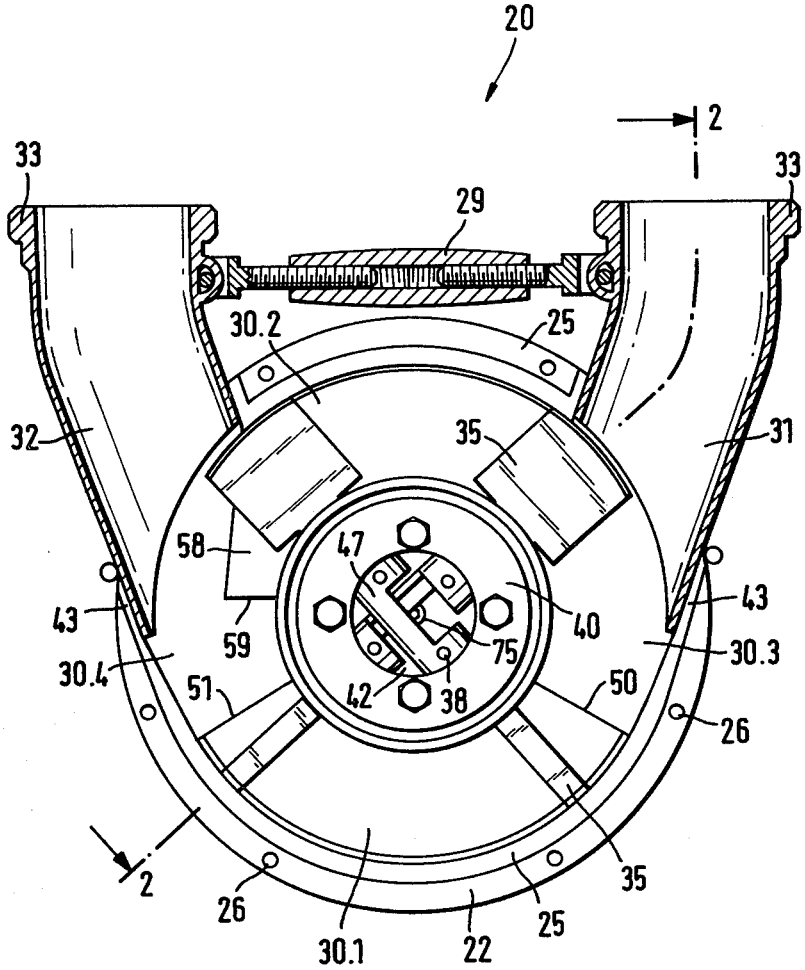
FIG. 1 is a cross section of a pump in accordance with the invention in a plane perpendicular to the axis of rotation.
Figure 2:
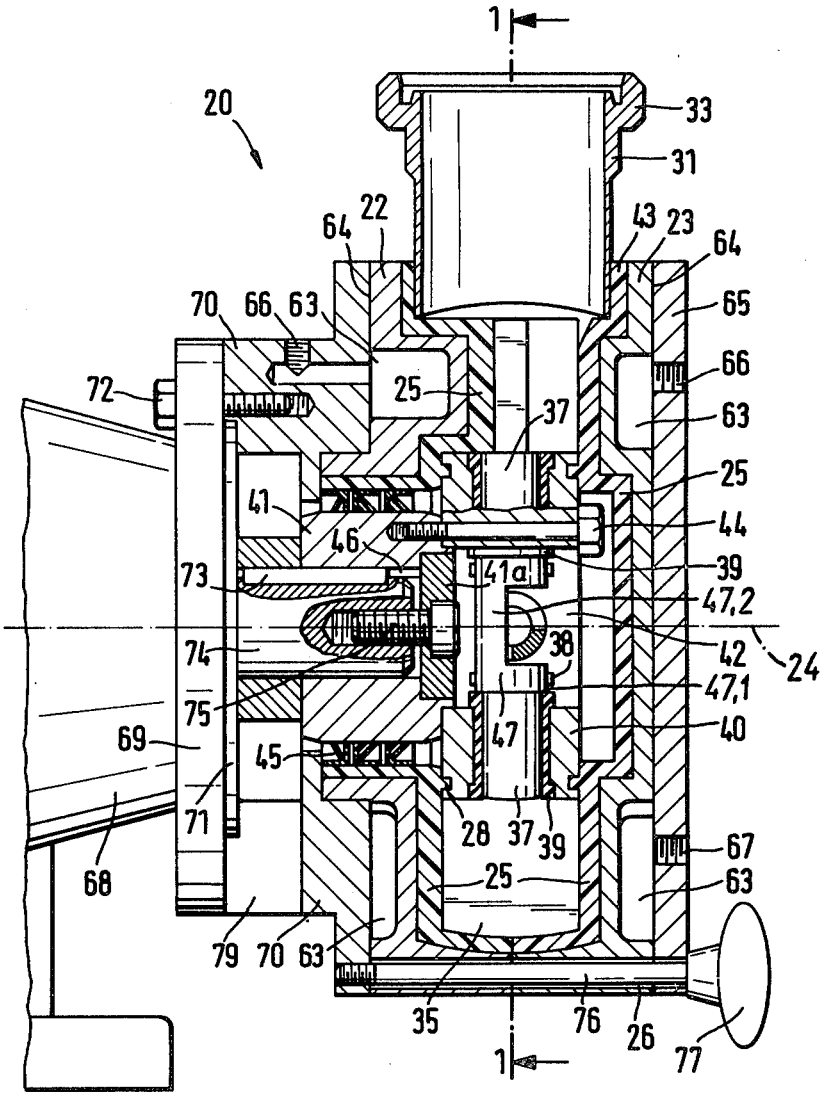
FIG. 2 is a section taken approximately on the line 2—2 in FIG. 1.

A pump in accordance with the present invention as illustrated in FIGS. 1 and 2 has a housing comprising a bottom or base portion 22 and a cover portion 23. The housing has an intake 31 and a discharge 32. A hub 40 with pivoted vanes 35 is rotatable in the housing. The pump can be driven in either direction so that there is no difference between the intake and the discharge. However, in the following description the rotor comprising the hub 40 and pivoted vanes 35 is assumed to rotate in a clockwise direction so that in FIG. 1 the intake 31 is at the right and the discharge 32 is at the left. As will be seen from FIG. 1 the circumferential distance between the intake 31 and the discharge 32 in the direction of rotation is greater than the circumferential distance between the discharge 32 and the intake 31. In operation the hub 40 rotates about the central axis 24 of the housing. Between the inner wall of the housing and the hub 40 there is formed an annular channel 30 which is divided functionally into different parts. The zone between the intake 31 and the discharge 32 in the direction of rotation of the rotor is the conveying or transport channel portion 30.1 and the zone between the discharge 32 and the intake 31 is the sealing channel portion 30.2.

In the illustrated embodiment, there are two pairs of opposite pivoted vanes 35 disposed at an angle of 90° to one another. The pivot pins 37 for the vanes 35 are disposed radial to the axis of rotation 24. The pivot pins 37 of each pair of opposite vanes 35 are connected with one another by a connecting member 47. The connecting member is tubular with cylindrical end portions 47.1 fitting over inner end portions of the pivot pins 37 and secured thereto by transverse pegs 38. An intermediate portion of the tube is cut away to leave an integral portion 47.2, which is a quarter of the cylindrical tube, connecting the end portions 47.1 and thereby rigidly connecting the pivot pins 37 of opposite vanes. A connecting member of this kind can be easily produced by sawing a circular cylindrical tube. It assures a rigid connection between the two pivot pins 37. This is a particular advantage for pumps of this kind with which, for example, liquids containing impact sensitive objects, for example, pieces of fruit are to be pumped. In such case with pivot pins elastically coupled, a vane can snap back upon being freed from clamping a large object so as to deliver a destructive blow to the material being pumped. This is avoided with the rigid connection of the pivot pins 37. Through the form of a quarter of a cylindrical tube it is assured that the two crossing connecting bars which in the present case pivot back and forth about 90° can extend through the hub 40 without interfering with one another during pivotal movement of the vanes.

In the illustrated embodiment, the pivoted vanes 35 are disc-form with a large four-cornered cross sectional face which is formed with three sides perpendicular to one another of which parallel sides are of equal length and a fourth side which is arcuate with a radius which corresponds to the maximum radius of the annular channel. In a plane perpendicular to the opposite faces of the vanes there is a corresponding cross section except that the parallel straight sides are much closer together.

Each of the vanes 35 is fixed on the outer end of the respective pivot pin 37 which is rotatable in a plastic bearing bushing 39 in the hub 40. The two opposite vanes 35 of a pair are disposed at 90° to one another and are connected with one another by the connecting tube 47 as described above. The transport portion 30.1 of the annular channel has a cross section which corresponds to the disc-shaped vanes 35. In FIG. 1 the lower vanes are oriented so that they are crosswise and completely close the transport channel cross section. Hence, by rotation of the pump rotor, the vanes propel the medium being pumped from the intake 31 to the discharge 32. The transport channel 30.1 extends from its entrance 50 to the exit 51 over an angular zone of more than 90°.

When the hub 40 turns further, one vane which has just past the discharge 32 continues in the direction of the intake 31. If the vane 35 were to move through the sealing channel portion 30.2 with the same cross sectional area as in the transport channel portion 30.1 exactly as much of the medium being pumped would be transported to the intake as was transported from the intake to the discharge. In order to prevent this and thereby carry out an effective pumping action, the pivoted vanes 35 must be turned so that in passing through the sealing canal portion they have a smaller cross section than in the transport channel portion. In the illustrated embodiment this is accomplished by turning the disc-shaped vanes 35 through an angle of 90°. In other embodiments the vanes may for example be pivoted into the hub. In the present case the vane pivoting is effected in the manner that each pivoted vane in the zone of the pressure discharge opening 32.1 engages the entrance edge 59 of a ramp 58. The vane is thereby turned 90° about the axis of a pivot pin and enters the sealing channel portion 30.2 which is so narrowed by inserted sealing pieces that it seals against the pivoted vanes which pass edgewise through the sealing portion of the channel. The sealing channel portion 30.2 extends between the discharge 32 and the intake 31 over an angle of about 90°.

Before a vane 35 again enters the transport channel portion 30.1 through clockwise rotation of the pump rotor, it must be turned back 90°. This is effected through the rigid coupling between the two opposite vanes. Thus when a vane which is oriented crosswise of the direction of movement passes out of the transport channel portion 30.1 and engages the ramp 58, it not only is itself turned 90° but also by reason of the rigid coupling between opposite vanes it also turns the opposite vane in the entrance of the transport channel portion 30.1 through 90° so that it is crosswise of the channel.

Instead of rotation of the pivoted vanes in the manner described above, the vanes can be rotated by a control device in the interior 42 of the hub 40. Control mechanism of this kind and also other embodiments of pivoted vanes are disclosed for example in U.S. Pat. Nos. 3,895,893 and 3,985,479 and also in German patent specification No. 28 45 658.

The four-cornered shape of the pivoted vanes 35 as illustrated in the drawings and described above is especially advantageous for high quality pumping of food or abrasive materials. However, such vanes and the corresponding annular channel parts are more difficult to produce and to seal than with the use of circular disc shape vanes. However, with the four-corner form shown and described, a larger cross sectional area can be obtained with the same height and width of the annular channel 30. Because of this greater cross sectional area and the greater pump volume per revolution, the pump can run slower for a given delivery volume whereby foodstuff is handled gently and abrasive material can be pumped with less wear. In the illustrated embodiment, the entire annular channel is covered with a plastic layer formed in one piece with the sealing pieces. The inner cross section of the plastic layer in the transport canal portion fits the shape of the pivoted vanes 35. Such plastic covering is shown more fully in FIGS. 3 and 4. Thus in FIG. 3 there is shown a metallic housing base portion 22 to which is vulcanized a plastic cladding 25. FIG. 4 shows the same construction in a section taken along the line 4—4 in FIG. 3 looking toward the suction opening 31.1 on which the intake 31 (not further shown in FIGS. 3 and 4) is set.

Figure 3:
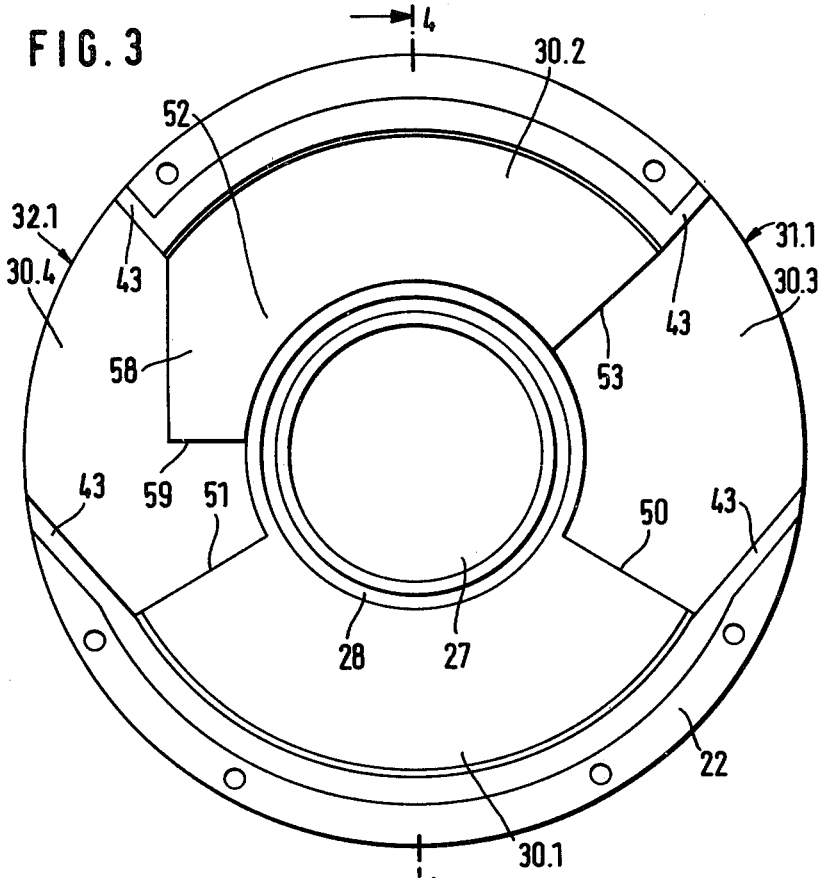
FIG. 3 is a plan of the base portion of the pump housing with a plastic lining vulcanized thereon.
Figure 4:
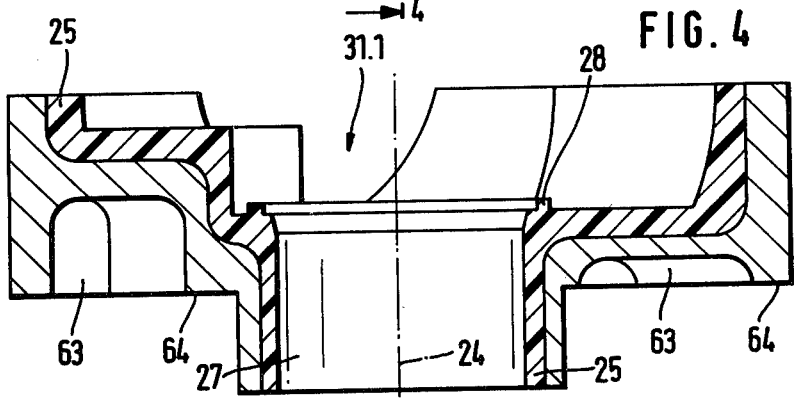
FIG. 4 is a section taken approximately on the line 4—4 in FIG. 3.

As seen in FIG. 3, the housing base portion has a central bore 27 to receive the drive for the hub 40 as seen in FIG. 2. In FIG. 3 the lower portion of the housing base portion 22 represents the base of the transport channel portion 30.1 while the upper portion represents the base portion of the sealing channel portion 30.2. In FIG. 4 the transport channel portion 30.1 lies to the right of the axis of rotation 24 while the sealing channel portion 30.2 lies to the left. The inner form of the housing base portion 22 is so formed that it has the above-described cross sectional form of the transport channel portion 30.1 and the sealing channel portion 30.2. The housing base portion 22 is thus provided on its entire inner contour including the hub drive bore 27 with a plastic layer 25. Around the hub drive bore 27 the plastic layer 25 has a ring-form sealing web 28 which fits into a sealing groove in the hub 40 as seen in FIG. 2.

In the transport channel portion 30.1 and in the sealing channel portion 30.2 the plastic cladding 25 is so formed that it forms a tight seal with the pivoted vanes 35. However, between the transport channel portion 30.1 and the sealing channel portion 30.2 the plastic cladding 25 is not made as high so that between the transport canal portion 30.1 and the discharge opening portion 30.4 which opens into the discharge opening 30.2 there is seen in FIG. 3 a line 51 which represents the end of the transport channel portion. On the other hand, between the discharge opening portion 30.4 and the sealing channel portion 30.2 there is seen the forward end 59 of the ramp surface 58 for rotating the pivoted vanes. Also in the intake portion 30.3 the plastic cladding 25 is not as high as in the transport channel portion 30.1 or in the sealing channel portion 30.2. Hence, in the plane view shown in FIG. 3, there are seen the line 53 which represents the end of the sealing channel and the line 50 which represents the beginning of the transport channel portion. Instead of a reduced thickness of the plastic covering 25 in the intake opening portion 30.3 and the discharge opening portion 30.4 the metal of the housing underlying these portions can be correspondingly recessed.

The plastic coating 25 also covers the inner walls 43 of the intake opening 30.1 and of the discharge opening 30.2. A short feed pipe 31 and a short discharge pipe 32 are pressed respectively into these coated openings. In order to be able to provide a better sealing of the suction pipe 31 and discharge pipe 32 in the openings 31.1 and 32.1, there is provided between the two pipes a tension device 29 through which the two pipes can be drawn toward one another. As seen in FIG. 1, the tension device is in the form of a turn-buckle opposite ends of which are pivotally connected with the intake pipe 31 and discharge pipe 32 respectively. This construction has the advantage that even in the joints between the connecting pipes 31 and 32 and the annular channel 30 the pump can easily be fully disassembled and thoroughly cleaned. However, the connecting pipes can be made integral with the housing base portion 22 whereupon the plastic covering can extend integrally from the annular channel 30 to the ends of the connecting pipes. However, such construction would be complicated to cast. The connecting pipes 31 and 32 are provided at their outer ends with flanges 33 for connection with conduits which are not shown in the drawing.

Figure 5:
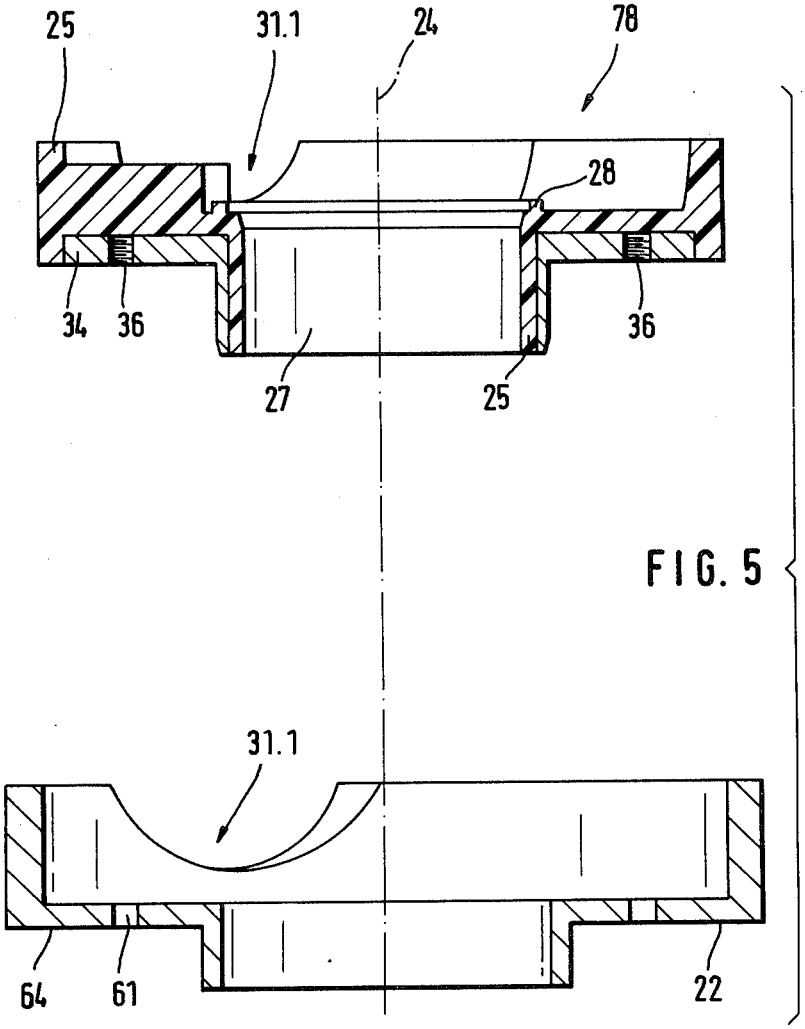
FIG. 5 is an exploded section through the base portion of the housing with a removable plastic lining.

A further form of the plastic covering 25 is illustrated in FIG. 5. The plastic covering 25 has essentially the same inner form as shown in FIG. 4 but instead of being vulcanized to the housing it is vulcanized to a carrier plate 34. This carrier plate 34 is provided with tapped holes 36. The carrier plate 34 together with the plastic covering 25 vulcanized or adhesively secured thereon is received in a metal housing base portion 22 shown in the lower part of FIG. 5. By means of screws (not shown) extending through aligned holes 61 in the housing base portion 22 and screwed into the tapped holes 36, the carrier plate 34 together with the plastic covering 25 is securely but removably affixed to the housing base portion 22.

In FIGS. 3 to 5 there is shown only a base portion 22. The housing cover portion 23 is, however, correspondingly formed as seen from FIG. 2. Both the housing base portion 22 and the housing cover portion 23 are advantageously provided with cooling channels 63 which extend in from the outer side 64. The cooling channels are formed in such manner that the metal housing wall between the cooling channel 63 and the plastic covering 25 in all places is only as thick as is required for reasons of stability. In this manner it is assured that the cooling channels lie as close as possible to the plastic covering so that the plastic covering is effectively cooled and prevented from overheating. If, on the other hand, a very cold medium is being pumped which might render the plastic covering 25 brittle by reason of overcooling, a heating medium can be supplied to the channels 63 instead of a cooling medium.

Figure 6:
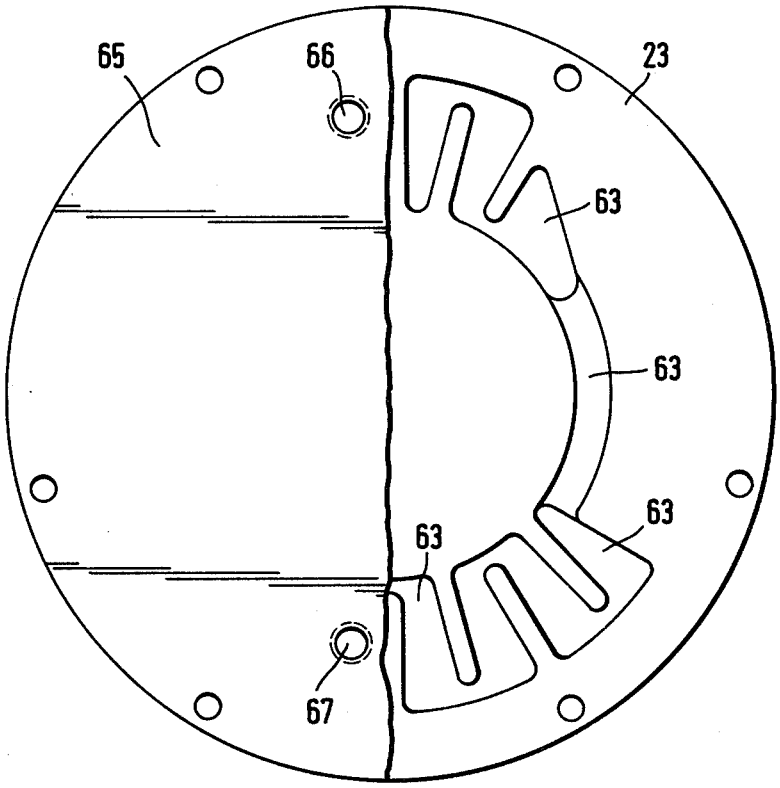
FIG. 6 is a plan of the cover portion of the housing with a superposed partially cut away cover plate.
Figure 7:
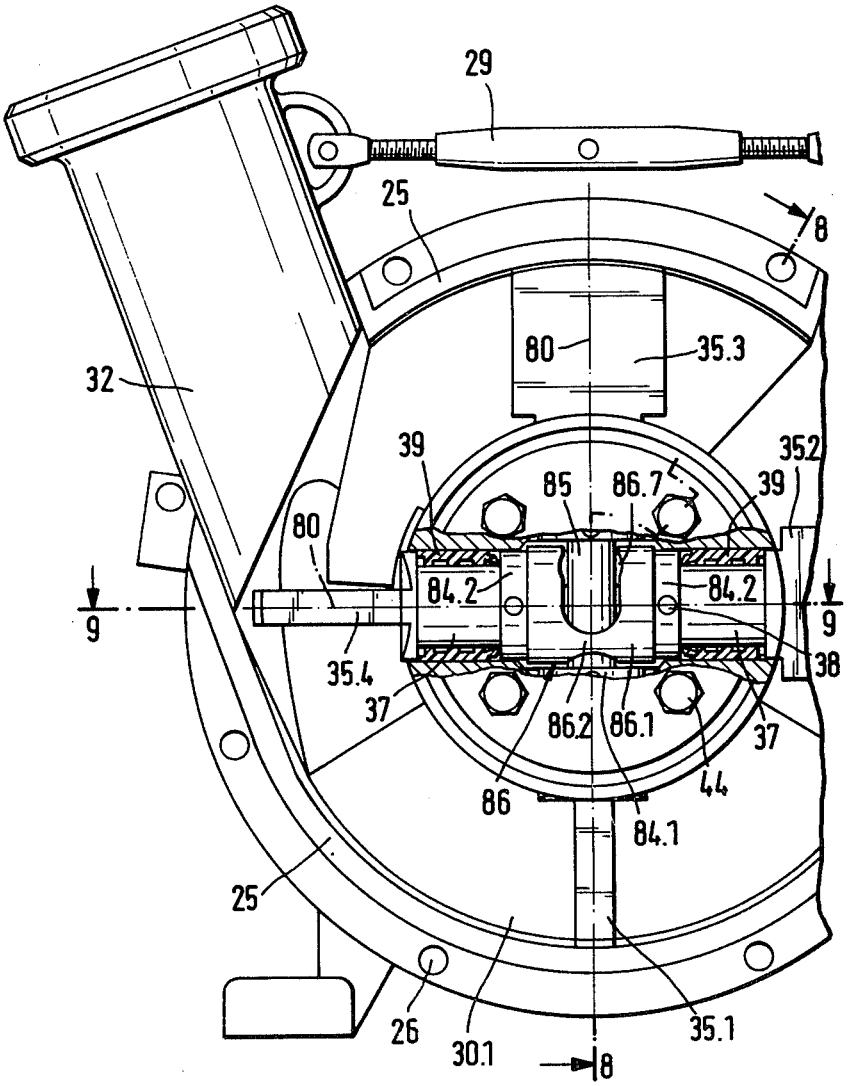
FIG. 7 is a cross section similar to FIG. 1 but showing another embodiment.

In the left-hand portion of FIG. 6 such a cooling channel 63 in the housing cover portion 23 is covered by a cover plate 65 which is broken away to show the cooling channel in the right-hand portion of the figure. In the cover plate 65 there are provided a cooling medium inlet 66 and a cooling medium outlet 67.

Further features and characteristics of a pump in accordance with the present invention will now be described with reference to FIG. 2. From this figure it will be seen how easily a pump in accordance with the invention can be assembled. The pump 20 consists essentially of a mounting flange 70, a base portion 22, a cover portion 23, a cover plate 65, a hub 40 with pivoted vanes 35, a short suction pipe 31 and a short discharge pipe 32. The mounting flange 70 serves for mounting the pump on the flange 69 of a motor 68. The mounting flange 70 serves at the same time in the illustrated embodiment as a sealing plate for the cooling channels 63 formed in the base portion 22. The cover plate 65 closes the cooling channel 63 in the cover portion 23. The connecting flange 70 and the cover plate 65 are provided with inlets 66 and outlets 67 for the cooling (or heating) medium.

In assembling the pump, the connecting flange 70 is centered on the motor flange 69 by a centering ring 71 and is secured by screws 72 extending through holes in the motor flange and screwed into tapped holes in the connecting flange 70. Next is put on the base portion 22 in the hub driving bore of which there is a driving bushing 41 surrounded by a shaft packing 45. The driving bushing 41 is secured to the motor shaft 74 by a screw 75 extending through a washer 41*a* set in a countersunk recess in the driving bushing. Moreover, the driving bushing 41 has a groove 46 which receives a key 73 set in a corresponding groove in the shaft 74 to assure that the driving bushing rotates with the shaft. If any liquid leaks out past the shaft seal 45, it is discharged through an opening 79.

The hub 40 is secured to the driving bushing 41 by four screws 44. One of these screws is shown in FIG. 2 while the location of the screws is indicated in FIG. 1. Instead of the hub 40 and driving bushing 41 being formed of separate pieces, they can be made integral with one another.

The housing cover portion 23 is now placed over the rotor comprising the hub and the pivoted vanes and the cover plate 65 is assembled on the housing cover portion 23. The housing base portion 22, housing cover portion 23 and cover plate 65 are thereupon secured to the connecting flange 70 by means of screws 76 which pass through aligned holes 26 in the cover plate 65, the housing cover portion 23 and the housing base portion 22 and are screwed into tapped holes in the connecting flange 70. One of the screws 76 is seen in FIG. 2 while the location of the holes 26 is indicated in FIG. 1. At their free ends the screws 76 have knobs 77 by means of which the screws can be easily tightened and loosened. However, before the screws are tightened, the suction pipe 31 and the discharge pipe 32 are inserted in the intake opening 31.1 and the discharge opening 32.1.

When, as illustrated for example in FIG. 5, the housing base portion 22 and housing cover portion 23 are not provided with cooling channels, the cover plate 65 and the connecting flange 70 are not necessary. The housing base portion 22 and cover portion 23 can then be secured directly to a flange, advantageously directly to the motor flange 69.

With the described construction a pump of the kind described can be disassembled and again assembled in a very short time. It is thereby possible easily to clean the pump and quickly to replace worn parts, for example a plastic insert 78 or a plastic bearing bushing 39.

The plastic lining 25 of the pump is a molded part which, as described above, is vulcanized either directly on inner surfaces of the housing portions 22, 23 or is vulcanized on a carrier plate 34 which is then secured to the housing portion. For example a mold of the required shape is heated to a temperature of about 180° C., the raw material is positioned in the mold which is then closed and maintained at approximately the same temperature. After about ten minutes the vulcanized part can be removed from the mold. The thickness of the lining is about 6 to 15 mm and preferably about 10 mm. As seen in FIG. 4, the portion in the hub drive bore 27 is somewhat thinner.

The plastic lining is formed of a material which is inert to the materials being pumped and is abrasion resistant. For a pump that is to be used in pumping foodstuff, the lining must be of a material which does not impart any taste or odor to the product being pumped. Examples of suitable material are "Perbunan", Acrylnltril-Butadien-Rubber (International Designation NBR), Silicone, Silicon Rubber (International Designation Q) and "Viton" a Fluoroelastomer based on the copolymer of vinylidene fluoride and hexafluoropropylene (International Designation FPM). The material should, as a rule, have a hardness of 60 to 70 Shore A, preferably about 65. The same material can be used for the bearing bushings 39 for the pivot pins 37 of the vanes 35. However, other plastic material having abrasion resistance and a low coefficient to friction can be used for the bushings.

In FIGS. 7 to 10 there is shown another embodiment of a pivoted vane rotary pump in accordance with the present invention. In these figures like parts and parts that are closely similar are designated by the same reference numbers as in previous figures. The construction and operation of the pump is the same as previously described except for the following differences.

Figure 8:
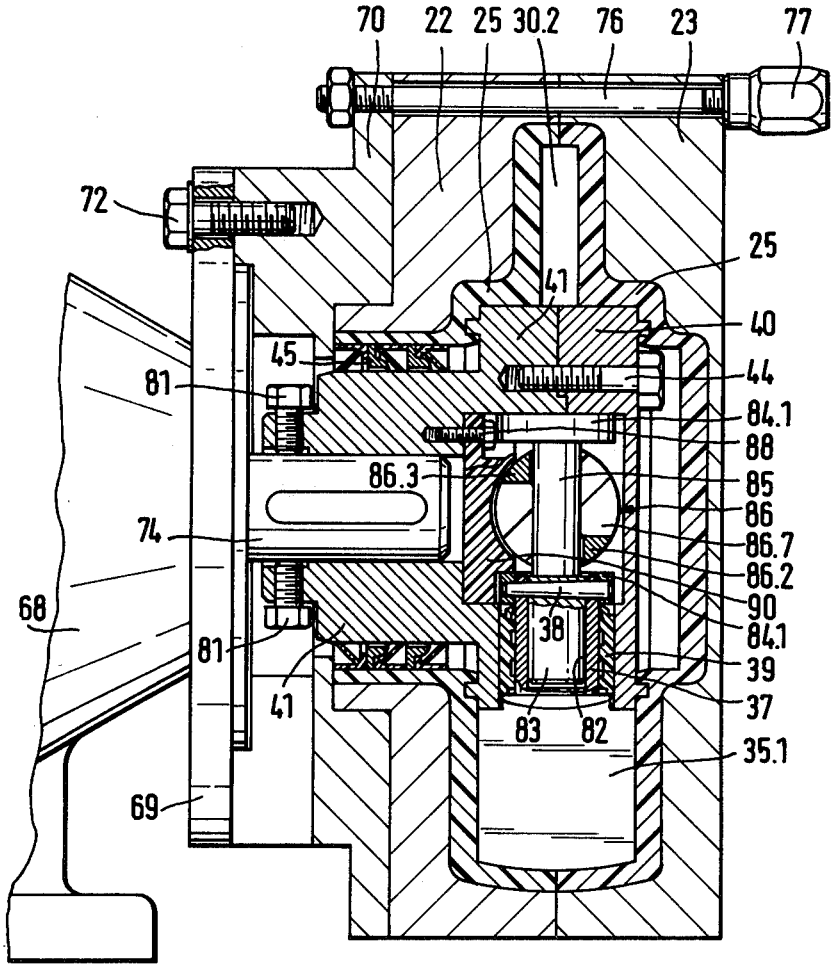
FIG. 8 is a section taken approximately on the line 8—8 in FIG. 7.

Instead of being secured to the motor shaft 74 by a screw 75 as illustrated in FIG. 2, the driving bushing 41 is secured to the motor shaft 74 by two opposite set screws 81 as seen in FIG. 8. This provides room to accommodate an axial guide member for the pivot pins of the vanes as will be described below.

Instead of the pivot pins of opposite vanes being interconnected by quarter tubular connecting bars as in the first embodiment, opposite vanes rotatable about a pivot axis 80 are rigidly connected with one another in a manner that will now be described. Each of the pivot pins 37 has an axial bore 82 of the same size to receive a connecting pin 83. The pivot pin 37 and connecting pin 83 are connected with one another and with an axial guiding ring 84 by a conical peg 38.

The pair of vanes 35.1 and 35.3 which appear as upper and lower vanes in FIG. 8 are rigidly connected with one another by a central connecting bar 85 which is integral with connecting pins 83 and of somewhat smaller diameter. The other pair of vanes 32.2 and 32.4 are connected with one another through a connecting part 86 which has a cylindrical portion 86.1 in which, as seen in the drawings, there is an oblong hole 86.7 so that the central connecting bar 85 can pass and the member 86 can turn 90°. Accordingly, there remain two opposite ring elements 86.2 and 86.3 which, as seen in FIG. 8, have a cylindrical outer surface and inner surfaces defined by segmental surfaces perpendicular to one another. The tow connecting portions 86.2 and 86.3 are thus in effect sector shape in cross section as seen in FIG. 8. These two opposite connecting portions 86.2 and 86.3 provide a rigid and stable connection as in the first embodiment so that in spite of the plastic bearing bushings 39, a bending of the vanes 35 relative to one another is prevented even when pumping media containing large solid portions. The entire cylindrical part 86.1 has the same outer diameter as the ring elements 86.2 and 86.3. This diameter 87 is somewhat greater than the diameter of the axial guide rings 84 and substantially greater than the diameter of the connecting pins 83. The cylindrical part 86.1 is formed integrally with the connecting pins 83. It is preferably turned from high strength steel or formed by forging and then machined. The connecting pins 83 fit in the tubular pivot shafts 37 to which they are rotationally fast through the conical pegs 38. The two axial guide rings 84.2 on the pivot shafts 37 of the two pivoted vanes 35.2 and 35.4 have an outer diameter which is smaller than that of the cylindrical part 86.1 of the connecting part 86 for a reason explained below. Also the central connecting bar 85 is made of steel or other suitable metal so as to provide a rigid connection between the opposite vanes 35.1 and 35.3. In any case, it must have the required rotational rigidity and bending stiffness in order to connect the pivoted vanes in a tortionally rigid and unbending manner.

Figure 9:
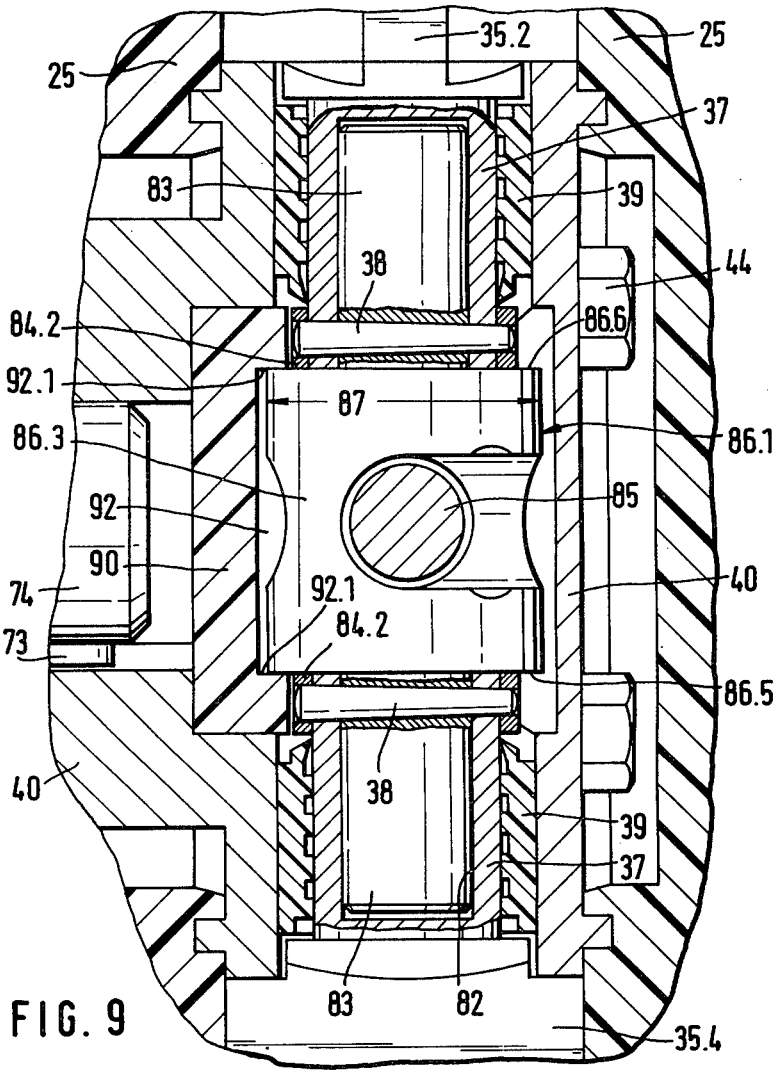
FIG. 9 is a cross section taken approximately on the line 9—9 in FIG. 7.
Figure 10:
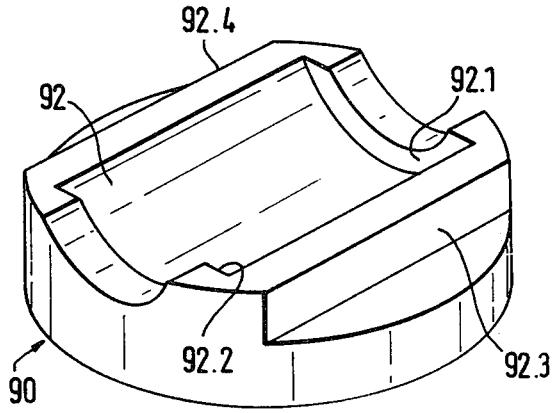
FIG. 10 is a simplified perspective view of an axial guiding member of the pump.

The pivoted vanes 35 are preferable fixed in an axial direction through special axial guiding means so that especially in the intake zone they do not move outwardly or inwardly and thereby subject the surface of the channel to unnecessary wear. For this axial guiding there is provided in accordance with the invention an axial guiding member 90 essential surfaces of which are seen in the perspective view of FIG. 10. As seen in FIG. 8, the axial guiding member 90 is secured to the guiding bushing 41 near the end of the driving shaft 74 by means of screws 88 extending through screw holes which are omitted in FIG. 10. The axial guiding member 90 has a partially cylindrical depression 92 of which inner end faces 92.1 and 92.2 serve as axial guiding faces which, as seen in FIG. 9, are engaged by annular surfaces 86.5 and 86.6 of the cylindrical part 86.1 so as to hold the connecting member 86 and hence the two opposite pivoted vanes against axial movement in either direction. It will be seen that the axial recess 92 is only deep enough to accommodate that portion of the cylindrical part 86.1 which extends radially beyond the axial guide rings 42 which are here as small as possible. Thus the axial guiding part 90 does not need to have a great height and it is possible to insert the hub with the pivoted vanes and connecting elements only from one side. This provides for rapid assembling, diassembling and replacement of parts.

The fixing of the two other pivoted vanes 35.1 and 35.3 in an axial direction is effected by the same axial guiding member 90 with the help of axial guide rings 84.1 secured on the corresponding pivot shaft 37. These have an outer diameter greater than the axial guide rings 84.2 because there is here no limitation through the size of the supporting surfaces. As seen in FIG. 8 the inner faces of axial guide rings 84.2 engage plane faces 92.3 and 92.4 of the axial guide member 90 (see FIG. 10). Thus the same axial guide part 90 serves to prevent axial movement of both pairs of pivoted vanes.

The axial guide member 90 is formed of high strength plastic material with a low coefficient of friction, in particular polyoxymethylene known by the International Designation POM. It is thus a plastic material which is relatively rigid and has good wear resisting properties and thus is able to support the vane pairs against axial movement with relatively small bearing surfaces.

While preferred embodiments of the invention have been illustrated in the drawings and are herein particularly described, it will be understood that various modifications may be made and that the invention is in no way limited to these embodiments.

What I claim is:

1. A pivoted vane rotary pump in particular for foodstuffs and abrasive media comprising:

a split housing comprising two separable parts and having an intake and a discharge circumferentially spaced from one another by at least 90°, a rotor rotatable in said housing and comprising a rotatable rotor hub and a plurality of vanes of corrosion resistant metal pivotally mounted on the periphery of said hub, one of said housing parts having a bore to rotatably receive said hub, an annular channel formed between the outer periphery of said hub and the inner periphery of said housing, said channel comprising a transport portion extending, in the direction of rotation of the rotor, from said intake to said discharge and a sealing portion of reduced cross section extending from said discharge to said intake, means for pivoting said vanes between a position in said transport channel portion in which they occupy the full cross sectional area of said transport portion and a position in said sealing channel portion in which they conform to the smaller cross sectional area thereof, a lining of low friction plastic material fully covering the inner surfaces of said housing defining said annular channel and slidingly engaged by said vanes as said rotor rotates, said lining being secured to said inner surfaces and protecting said housing from attack by corrosive media and from abrasive media being pumped, said plastic lining extending into said hub-receiving bore of said housing part, and means providing a fluid-tight seal between said plastic lining and said hub.

2. A pump according to claim 1, in which the plastic material of said lining is a corrosion and abrasion resistant elastomeric plastic material.

3. A pump according to claim 2, in which said housing parts are of metal and said plastic lining is vulcanized directly to inner surfaces of said housing parts.

4. A pump according to claim 2, in which said plastic lining is vulcanized to metal carrier plates which are removably and replaceably secured on inner surfaces of said housing parts.

5. A pivoted vane rotary pump in particular for foodstuffs and abrasive media comprising:

a split housing comprising two separable parts and having an intake and a discharge circumferentially spaced from one another by at least 90°, a rotor rotaatable in said housing and comprising a rotatable rotor hub and a plurality of vanes pivotally mounted on the periphery of said hub, an annular channel formed between the outer periphery of said hub and the inner periphery of said housing, said channel comprising a transport portion extending, in the direction of rotation of the rotor, from said intake to said discharge and a sealing portion of reduced cross section extending from said discharge to said intake, means for pivoting said vanes between a position in said transport channel portion in which they occupy the full cross sectional area of said transport portion and a position in said sealing channel portion in which they conform to the smaller cross sectional area thereof, and a lining of plastic material fully covering the inner surfaces of said housing defining said annular channel, said lining being secured to said inner surface and protecting said housing from attack by corrosive media and from abrasive media being pumped, said housing being divided in a plane perpendicular to the axis of rotation of the rotor into a base portion and a cover portion which together provide openings for receiving an intake pipe and a discharge pipe, said plastic lining extending into said openings, and a metal intake pipe and a metal discharge pipe received respectively in said openings, said plastic lining in said openings providing a seal between said pipes and said housing and providing a resilient connection with said pipes.

6. A pump according to claim 5, in which a tension device extending between said pipes is operable to draw them toward one another.

7. A pump according to claim 1, in which said vanes are disc-shaped vanes having pivot pins extending radially into the hub and in which said pivot pins are rotatable in cylindrical plastic bearing bushings in the hubs, said plastic bearing bushings having in their inner surfaces annular grooves separating annular ring portions engaging said pivot pins.

8. A pump according to claim 1, in which said vanes are disc-shaped vanes having pivot pins extending radially into the hub, and in which pivot pins of diametrically disposed vanes are rigidly interconnected by quarter cylindrical tubes.

9. A pump according to claim 1, in which said vanes have pivot pins extending radially into the hub and are disc-shaped with opposite parallel straight side edges, a straight inner edge and an arcuate outer edge having a radius of curvature equal to the radius of the outermost wall of said annular channel in a plane perpendicular to the axis of rotation of said rotor.

10. A pump according to claim 1, in which said housing parts are metallic and in which cooling channels are formed in said housing parts, the metal between said cooling channels and said plastic lining being only sufficient for stability of said parts.

11. A pump according to claim 10, in which said housing is divided in a plane perpendicular to the axis of rotation of the rotor into a base portion and a cover portion and in which said cooling channels are formed as grooves in outer faces of said base portion and cover portions and are closed by cover members secured to said base portion and cover portion respectively.

12. A pump according to claim 11, in which said cover members, said housing base portion and said housing cover portion are secured together by screws extending through one of said cover members, said housing cover portion and said housing base portion and into the other of said cover members.

13. A pump according to claim 1, in which said pump is driven by a motor having a flange thereon, and in which said housing is divided in a plane perpendicular to the axis of rotation of said rotor into a housing base portion and a housing cover portion which are secured together and to said motor by screws extending through said housing cover portion and said housing base portion and into said flange.

14. A pump according to claim 1, in which there are two pairs of pivoted vanes rotatable respectively about pivot axes disposed perpendicular to one another and in which the vanes of a first pair are rigidly connected with one another by a central connecting bar while the vanes of a second pair are connected with one another by a connecting member having cylindrical end portions integrally connected with one another by opposite connecting portions of sector-shaped cross section.

15. A pump according to claim 14, in which the pivot pins of said vanes are tubular and said central connecting bar has end portions received in said tubular pivot pins of said first pair of vanes and are secured therein by transverse pegs extending through aligned holes in said tubular pivot pins and said end portion of said connecting bar.

16. A pump according to claim 15, in which said connecting member has integral cylindrical portions received in said tubular pivot pins of said second pair of vanes and secured therein by transverse pegs extending through aligned holes in said tubular pivot pins and said cylindrical portions of said connecting member.

17. A pump according to claim 14, in which an axial guide member fixed to said hub engages guide rings fixed on said connecting bar of said first pair of vanes and engages opposite ends of said connecting member of said second pair of vanes to hold said pivot pins and respective vanes against axial movement while permitting pivotal movement.

18. A pump according to claim 1, in which annular supporting surfaces on pivot pins of said vanes engage supporting surfaces of a guide member rotating with said said hub to hold said pivot pins and the respective vanes against axial movement while permitting pivotal movement, said supporting surface engaging said annular supporting surfaces of said pivot pins only at one side of said pivot pins, whereby parts of the pump can be easily disassembled.

19. A pivoted vane rotary pump in particular for food-stuffs and abrasive media comprising:

a split housing comprising two separable parts and having an intake and a discharge circumferentially spaced from one another by at least 90°, a rotor rotatable in said housing and comprising a rotatable rotor hub and a plurality of vanes pivotally mounted on the periphery of said hub, said housing being divided in a plane perpendicular to the axis of rotation of said hub into a base portion and a cover portion, said base portion having a central bore in which said hub is rotatably received comprising a first portion, an annular channel formed between the outer periphery of said hub and the inner periphery of said housing, said channel comprising a transport portion extending, in the direction of rotation of the rotor, from said intake to said discharge and a sealing portion of reduced cross section extending from said discharge to said intake, means for pivoting said vanes between a position in said transport channel portion in which they occupy the full cross sectional area of said transport portion and a position in said sealing channel portion in which they conform to the smaller cross sectional area thereof, and a lining of low friction plastic material fully covering the inner surfaces of said housing defining said annular channel, said lining covering the entire inner surface of said cover portion and a second portion covering the entire inner surface of said base portion from the outer periphery of said annular channel to the periphery of said hub, and means providing a fluid tight seal between said second portion of said lining and said hub.

20. A pump according to claim 19, in which said seal means comprises an annular groove in said second portion of said plastic lining concentric with said hub and an annular bead on said hub received in said groove.

21. A pump according to claim 19, in which said seal means comprises an annular groove in said hub and an annular bead of said plastic lining received in said groove.

22. A pump according to claim 19, in which said cylindrical part of a second portion of said plastic lining extends into said bore of said base portion of the housing and in which a fluid tight packing is provided between said cylindrical part and said hub.

23. A pivoted vane rotary pump in particular for food-stuffs and abrasive media comprising:

a split housing comprising two separable parts and having an intake and a discharge circumferentially spaced from one another by at least 90°, a rotor rotatable in said housing and comprising a rotatable rotor hub and a plurality of vanes pivotally mounted on the periphery of said hub, an annular channel formed between the outer periphery of said hub and the inner periphery of said housing, said channel comprising a transport portion extending, in the direction of rotation of the rotor, from said intake to said discharge and a sealing portion of reduced cross section extending from said discharge to said intake, means for pivoting said vanes between a position in said transport channel portion in which they occupy the full cross sectional area of said transport portion and a position in said sealing channel portion in which they conform to the small cross sectional area thereof, and a lining of low friction plastic material fully covering the inner surfaces of said housing defining said annular channel and slidingly engaged by said vanes as said rotor rotates, said lining extending to said hub and being secured to said inner surfaces and protecting said housing from attack by corrosive media and from abrasive media being pumped, means providing a fluid tight seal between said plastic lining and said hub, each of said vanes comprising a four-cornered disc of corrosion resistant metal having parallel straight side edges and a curved outer end edge having the same radius of curvature as the outer periphery of said annular channel, said side edges being of arcuate cross section and being concentric with the pivot axis of the vane and said outer end edge in cross section having the same radius of curvature as the outer periphery of said annular channel, the transport portion of said annular channel having a four-cornered cross sectional shape corresponding to the shape of said vanes and the sealing portion of said annular channel having a cross sectional shape corresponding to a radial cross section of said vanes.

* * * * *